United States Patent [19]

Sudler et al.

[11] 4,233,680

[45] Nov. 11, 1980

[54] ELECTRIC CLOCK

[75] Inventors: Roland Sudler, Frankfurt am Main; Peter Kupferschmidt; Jean-Francois Schwab, both of Schwalbach, all of Fed. Rep. of Germany

[73] Assignee: VDO Adolf Schindling AG, Frankfurt am Main, Fed. Rep. of Germany

[21] Appl. No.: 902,435

[22] Filed: May 3, 1978

[51] Int. Cl.[3] ..... G04C 3/00

[52] U.S. Cl. ..... 368/76; 368/86; 368/155; 368/185

[58] Field of Search ..... 310/40 MM, 162, 164; 58/23 R, 23 D, 50 R, 85.5; 361/393, 395; 200/35 R

[56] References Cited

U.S. PATENT DOCUMENTS

| | | | |
|---|---|---|---|
| 2,607,188 | 8/1952 | Bourquin | 58/85 S |
| 3,356,876 | 12/1967 | Scholten | 310/162 |
| 3,461,663 | 8/1969 | Albringer, Jr. et al. | 582/3 BA |
| 3,898,789 | 8/1975 | Arzi et al. | 58/23 D X |
| 3,922,588 | 11/1975 | Kunzel | 58/23 R X |
| 3,943,695 | 3/1976 | Bauer et al. | 58/23 D |
| 3,968,417 | 7/1976 | Dials | 58/23 BA X |
| 3,981,139 | 9/1976 | Jackle | 58/23 R |
| 4,040,247 | 8/1977 | Haydon | 58/23 BA X |
| 4,086,753 | 5/1978 | Tsuchiya et al. | 58/23 D |

*Primary Examiner*—Ulysses Weldon

*Attorney, Agent, or Firm*—Martin A. Farber

[57] ABSTRACT

An electric clock with a quartz oscillator, a frequency divider connected following the latter and an output stage driven by the latter, in the output of the output stage there being disposed a single phase stepping motor which acts on a clockwork gear train driving the hour indicator and the minute indicator, as well as a storage battery supplying the operating voltage and a charging circuit for the battery. The single phase stepping motor and the clockwork gear train form a self-contained construction assembly. The quartz oscillator, the frequency divider, the output stage and the charging circuit are arranged on a single printed circuit board. The printed circuit board and the construction assembly are connected with one another via two electrically conducting pins secured on the excitation coil. The printed circuit board and the construction assembly are secured in common on a carrier plate, the latter having an opening for the hour tube and the minute tube, respectively.

6 Claims, 6 Drawing Figures

ELECTRIC CLOCK

The invention relates to an electrical clock with a quartz oscillator, a frequency divider connected to and following the latter and an output stage driven by the latter, in the output of which output stage there is disposed a single phase stepping motor which acts on a clockwork mechanism driving the hour indicator and the minute indicator as well as a storage battery or accumulator supplying the operating voltage and a charging circuit for the battery.

Known clocks of this type have a construction which is costly in construction components and unfavorable in production, and, if they are required for driving switch devices, for example, a heating installation, and as a consequence, a certain minimum torque must be available on their time tubes, a comparatively large construction volume results which is undesired to the highest degree not only for the previously stated purposes of use but rather also for other fields of use.

It is an object of the present invention to provide a clock of the introductory described type which has the smallest possible number of construction components and a construction which is most favorable in manufacturing. Particularly the clock is to be conceived such that it could be produced without difficulties in mass production, under circumstances with the use of completely automatic or semi-automatic mounting or assembling machines.

Moreover it is a task and object of the present invention to conceive a clock with as small a construction volume as possible.

It is a further object of the present invention to conceive a clock which can be produced in mass production, which clock is particularly suited for use in time dependent actuated switch devices.

It is another object of the present invention to aid in the solution of the above-mentioned object in the manner that the single phase stepping motor (9) and the clockwork gear train (11) form a self-contained construction assembly (2) first component, that the quartz oscillator (4), the frequency divider, the output stage and the charging circuit (12; 13) are arranged on a single printed circuit borad (7) forming an electrical assembly constituting a second component, that the printed circuit board (7) and the construction assembly (2) are connected with each another by means of two electrically conducting pins (38, 39), which pins are secured on the excitation coil (33), and that the printed circuit board (7) and the construction assembly (2) are secured jointly on a carrier plate (3), which carrier plate has an opening for the hour tube (44) and the minute tube (43), respectively, a third separate component comprising gear wheels of a switch device and a bearing for mounting the gear wheels of the switch device on a front side of the carrier element facing away from the clockwork gear train.

By this consequent subdivision of the clock into an electronic part which comprises the printed circuit board with the quartz oscillator, the frequency divider, the output stage and the charging circuit, and a mechanical part which contains the single phase stepping motor and the clockwork gear train, as well as by formation of both of these parts in assemblies or groups which are self-contained, it is achieved that both construction assemblies are produced with the most favorable production speed for them, and can be examined. In the event of manufacturing defects which may occur with one of the two assemblies, only this construction assembly is affected and not yet also components of the other assembly, so that the costs of damage can be considerably reduced in comparison to that of the known clocks. By the separation into a mechanical assembly and into an electronic assembly, beyond this, each of the two assemblies can be dimensioned according to the aspects or features required for it: The mechanical assembly can be designed and conceived exclusively according to the mechanical requirements, and the electrical assembly can be exclusively designed according to the technical or constructional circuitry aspects, so that each of the two assemblies can be optimumly constructed.

According to a preferred embodiment of the invention, the mechanical construction assembly (2) comprises a first and a second carrier element (18, 19) which are parallel to one another and in which there are mounted the shafts of the wheels or gears and of the rotor (22) as well as the hour tube and the minute tube, respectively. On the first carrier element (18) there are secured the flat stator sheets (28, 29) of the motor (9), which flat stator sheets carry the stator poles (30, 31), and in addition a shoulder or projection (20) is attached or formed thereon for mounting of one end of the rotor shaft (21). The other end of the rotor shaft (21) is mounted in a bearing (23) secured on the first carrier element (18). On the rotor shaft (21) there is fastened a magnetic disc (26), which is axially magnetized and which is parallel to the stator plates (28, 29), as well as on the rotor shaft (21) an iron disc (27) is freely rotatably mounted on the side of the magnetic disc (26) which side points away from the stator sheets (28, 29). On those parts of the stator sheets (28, 29) which are remote from the stator poles (30), there is secured a bridge part (32) with the excitation coil (33), the bridge part connecting the stator sheets, the excitation coil being located outside of the first carrier element (18).

Particularly with respect to the flat motor construction this embodiment has a particularly small construction volume with a comparatively high torque on the hour tube and the minute tube, respectively due to the magnetic damping. Beyond that, the motor, which is secured to the first carrier element, offers the advantage that it is particularly quiet, so that the clock can also be used there without additional damping measures, where a noiseless as possible operation occurs.

According to a further advantageous embodiment of the invention, on the front or face side of the second carrier element (19), which side faces away from the clockwork gear train (11) there are provided bearing means (61) for the wheels or gears (57, 58, 59) of the switch device. This measure brings the advantage therewith that the switch device gears can be mounted additionally or subsequently and without engagement in the gearwork train of the clock. Moreover beyond that, warehousing is simplified in the manner that there two different clockworks are not required to be held in supply, but rather merely only one clockwork, which prior to its mounting or assembly in the housing, under circumstances is completed with the clockwork gears or wheels.

Moreover it has proven advantageous to form the holder (54) of the minute pointer (53) as an adjustment knob. In this manner not only can a number of construction components be saved, which components are necessary for setting or adjusting the clock time with the known clocks, but also the possibility exists to further reduce the construction volume of the clock. In such cases instead of the seconds pointer it is recommended to use a disc (56) which is provided with markings, which disc is seated or mounted on the seconds shaft (43), and which disc rotates in a recess (55) of the adjustment knob (54) and indicates the running of the clock.

With the above and other objects and advantages in view, the present invention will become more clearly understood in connection with the following detailed description of a preferred embodiment, when considered with the accompanying drawings, of which:

FIG. 1 is a schematic circuit diagram of the electrical assembly of the clock;

FIG. 1*a* is a circuit diagram of an alternate charging circuit;

Figure 2:
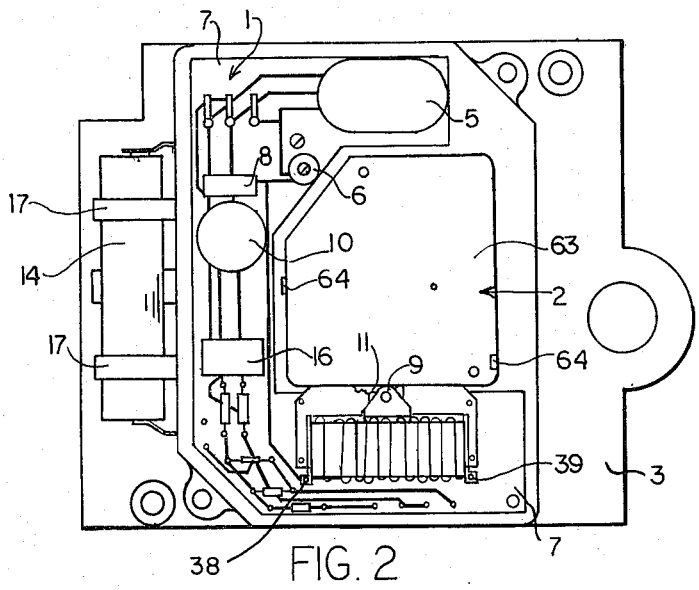
FIG. 2 is a rear view of the clock in the assembled condition.

Referring now to the drawings, as particularly evident from FIG. 2, the clock comprises an electrical construction assembly 1 and a mechanical construction assembly 2, which are both secured on a carrier plate 3.

Figure 1:
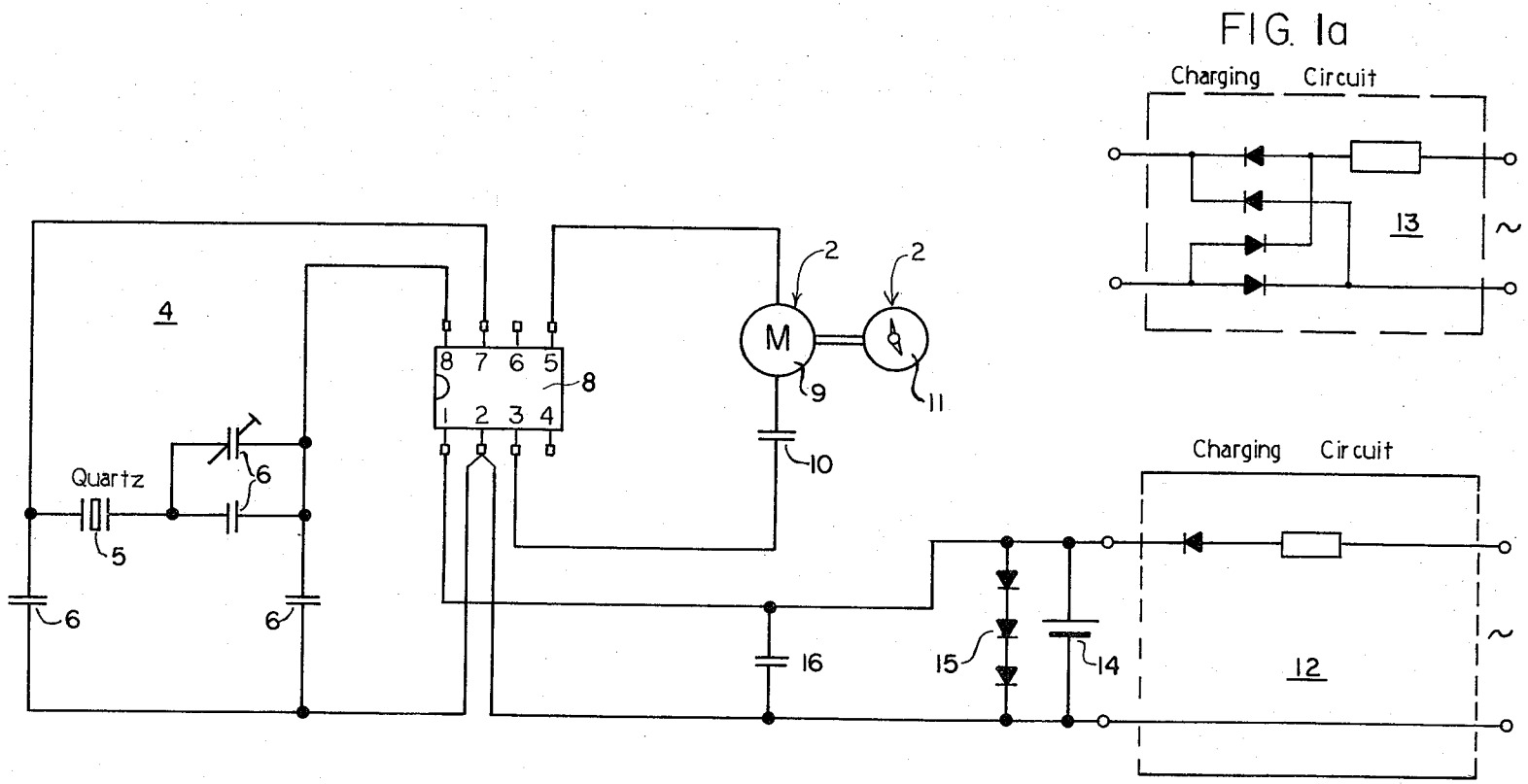

The electrical construction assembly comprises a quartz oscillator 4 (FIG. 1) with a piezoelectric quartz 5 and several capacitors 6 which are arranged in a discrete construction manner on a printed circuit board 7. The remaining part of the quartz oscillator 4 is located together with a frequency divider as well as an output stage on a CMOS chip, which is disposed in a housing 8 with eight connections or terminals. The motor 9 is connected to the output of the output stage, and a capacitor 10 is connected in series with the motor 9. The motor 9 is coupled with a clockwork grar train 11 and forms with the latter the mechanical construction assembly 2.

In addition on the printed circuit board 7 there is disposed a charging circuit 12 and 13, respectively. The charging circuit 12 is constructed as a half-wave rectifier, while the charging circuit 13 is constructed as a full-wave rectifier. Between the storage battery 14 and the electronic circuitry there is disposed a chain of diodes 15 as a protection against confusion of the poles and voltage peaks as well as a further smoothing capacitor 16. For securing the rod-shaped storage battery 14, three claw-like elastic arms or clips 17 are formed on or attached to the carrier plate 3, between which clips the battery can be pressed-in catch snappingly.

Figure 4:
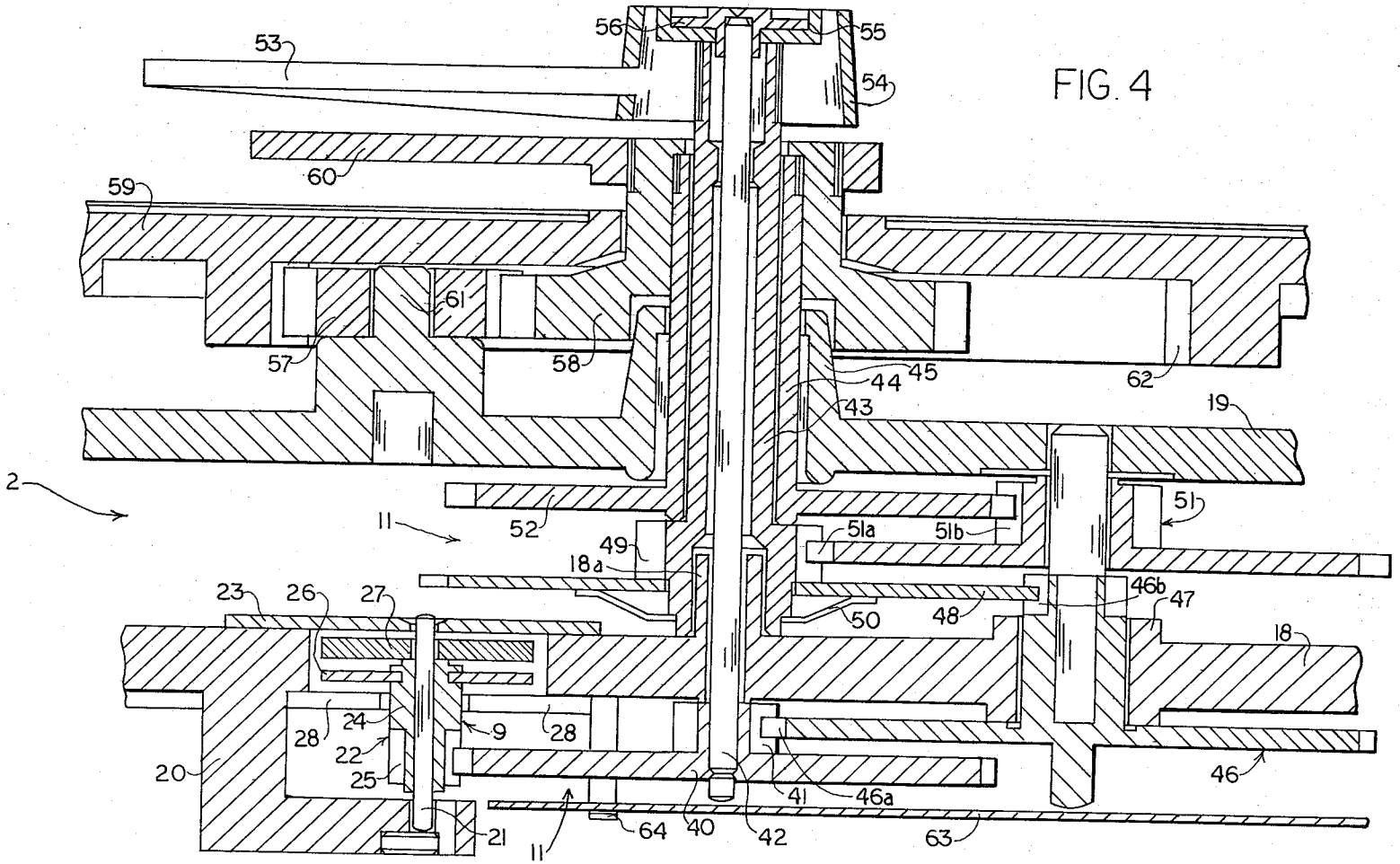
FIG. 4 is a cross-sectional view through the mechanical assembly of the clock.

As particularly illustrated in FIG. 4, the mechanical assembly 2 is made of two carrier elements 18 and 19 which are parallel to one another, and in which are mounted the shafts of the individual gears of the clockwork gear train. The carrier element 18 is provided with a projection or off-set 20 in which there is mounted one end of the shaft 21 of the rotor 22 of the single phase stepping motor 9. The other end of the shaft 21 is mounted in a sheet or sheet metal 23 forming a bearing, the sheet 23 being screwed onto the upper side of the carrier element 18. The rotor 22 essentially comprises a synthetic material or plastic body 24 which transfers or is formed on one end into a pinion 25 and the other end of which is surrounded by an axially magnetized magnetic disc 26 secured thereto. Over the latter there is disposed an iron disc or washer 27 which is freely rotatably mounted on the shaft 21 and serves as a return connection for the magnetic field lines or flux which originate from the magnetic disc 26. In a plane which is parallel to the magnetic disc 26, the two stator parts 28 and 29 of the single phase motor 9 are fastened onto the carrier element 18.

Figure 5:
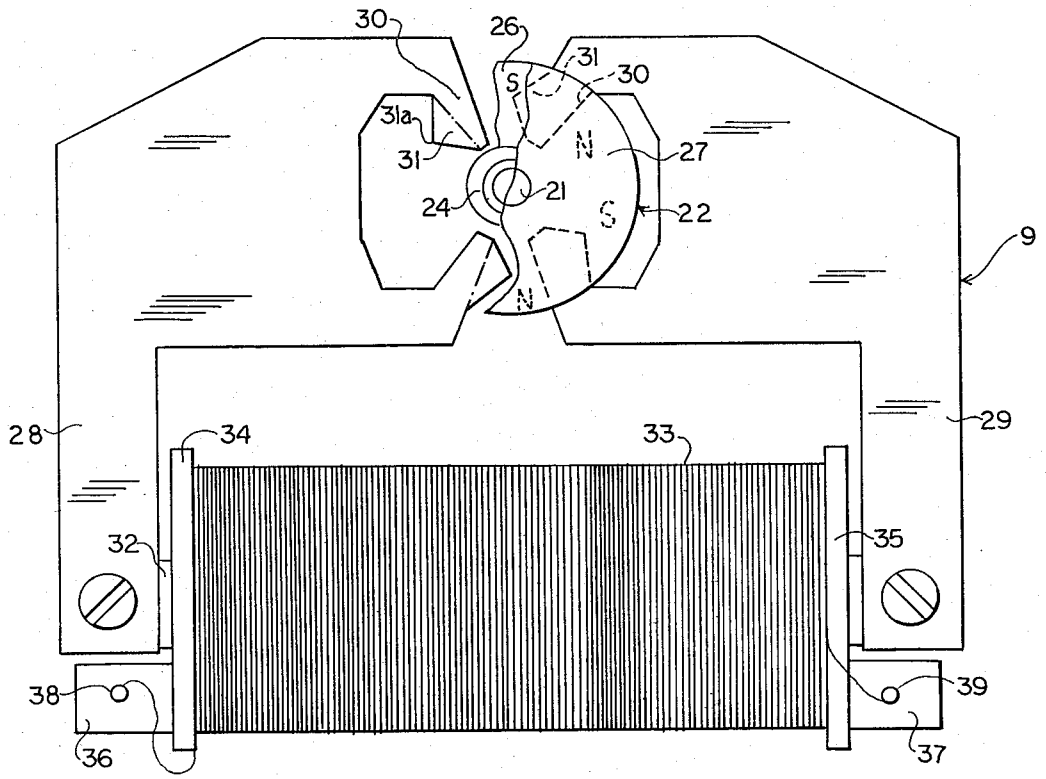
FIG. 5 is an elevational view of the single phase stepping motor of the clock, in enlarged view and broken away in part.

As evident from FIG. 5, each stator part 28 and 29, respectively, has two main poles 30 in the form of fingers which taper toward the rotor axis and triangular-shaped auxiliary poles 31 formed on the main poles. The free points 31*a* of the auxiliary poles 31 point in a direction counter to the direction of rotation of the rotor 22.

The stator poles 28 and 29 form an intergral unit respectively with the main poles 30 and auxiliary poles 31 which are associated thereto. Both units are well as a bridge part 32 which connects the two stator parts 28 and 29 are stamped out or punched out from a Hyperm 766 sheet or sheet metal. An excitation coil 33 is seated on the bridge part 32. On the flanges 34 and 35, respectively, of the coil there is attached a projection 36 and 37, respectively, with an electrically conducting pin 38 and 39, respectively. The pins 38 and 39 project with both of their ends, respectively, from the projection 36 and 37, respectively, and are connected on one of their ends thereof, respectively, with the wire of the excitation coil and project with their other ends in corresponding bores in the printed circuit board 7, where they are solded or caulk welded with corresponding printed conductor tracks.

The pinion 25 which is formed on the rotor body 24 intermeshes with a toothed gear 40, which together with a pinion 41 formed on the latter, is seated on the seconds shaft 42 of the dial train or motion work. The seconds shaft 42 on the one hand is mounted in the carrier element 18 through a projection 18*a* thereof and on the other hand by means of the minute tube 43 (which is rotatably seated on the projection 18*a*) and the hour tube 44 is mounted in a sleeve or bushing 45 which is formed on the carrier element 19. The pinion 41 intermeshes with an outer pinion 46*a* of an intermediate drive gear 46, which is mounted in a corresponding bearing bushing or sleeve 47 in the carrier element 18. The output pinion 46*b* of the drive 46 interengages with a toothed gear 48, the latter being mounted on its inner annular portion on the minute tube 43 and with friction being operatively connected with the pinion 49 formed on the minute tube 43. The friction is attained in this manner by a spring 50 which presses the toothed gear wheel 48 against the pinion 49. The pinion 49 in turn drives a drive 51, via an input pinion 51*a* formed thereon, and the output pinion 51*b* of which intermeshes with the hour gear or wheel 52, the latter forming with the hour tube 44 an integral one-piece unit.

The minute hand or pointer 53 is seated on the minute tube 43, the holder 54 of the minute pointer being formed in the shape of a setting or adjustment knob. The setting knob 54 has a recess 55 in which there rotates a disc 56, the disc 56 being provided with two color surfaces. The seconds shaft 42 is mounted on the disc 56 for rotating the latter.

On the forward or front side of the carrier element 19 there are attached or formed thereon, bearing means 61 for gears 57, 58 and 59 of a switch device. The gear 58 is pressed or forced on the hour tube 44 of the dial train and on its free end carries the hour pointer 60, which in case no switch device or mechanism is to be driven, is normally pressed directly onto the hour tube 44. The gear 58 intermeshes with three pinions arranged on a circle which is concentric to the seconds shaft, of which three pinions, merely the pinion 57 is illustrated for clarity of illustration. The pinion 57 is mounted on a bearing pin 61 formed on the carrier element 19. The pinions 57 drive the adjustment disc gear 59 which is provided with inner teeth 62 intermeshing therewith.

Figure 3:
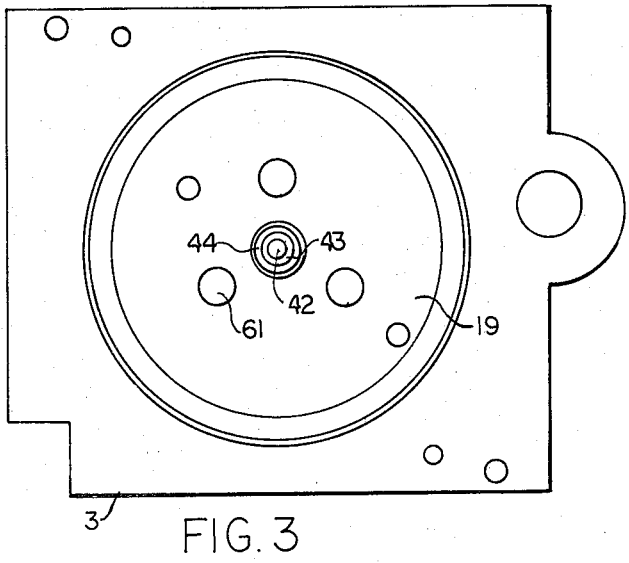
FIG. 3 is a front view of the clock in the assembled condition, with clock hands of the clock being removed.

The carrier element 19 is circularly shaped and is seated or mounted in a corresponding opening in the carrier plate 3 as particularly evident from FIG. 3.

For the axial securing of the seconds shaft 42 and the drive 46, there exists a thin sheet metal plate 63 which is held by means of holding arms 64 which are resiliently or elastically attached or formed on the carrier element 18.

The single phase stepping motor 9 for example comprises a six polar rotor 26 and a stator comprising the two stator parts 28 and 29 as well as the bridge part 32 connecting these two parts with the excitation coil 33. Both stator part 28 and 29, are arranged in one plane, whereas the rotor 26 rotates in a plane parallel thereto. The permanent magnetic disc 26, is axially magnetized, that means a south pole on one face side thereof stands opposite a north pole on the other face side.

In operation in the unexcited condition the rotor 22 and disc 26 are located in a rest position. In this position the magnetic resistance of the magnetic circuit is the smallest. The magnetic poles N and S, respectively, of the magnetic disc 26 are then located in a maximized position over the stator poles 30.

With an excited stator the rotor 22 is rotated clockwise as viewed in the drawings by action of the auxiliary poles 31 into a new position in which the main poles 30 of the stator lie maximized relative to or between the magnetic disc poles (e.g. note FIG. 5). Now the auxiliary poles 31 project into the range of the magnetic poles N, S of the magnetic disc 26 of the rotor 22. As soon as the excitation of the stator is terminated, the rotor 22 is rotated further clockwise by the auxiliary poles 31 and the magnetic poles into the next rest position. In operation pulses are fed to the excitation coil 33 causing the rotor 22 of the single phase stepping motor to undergo its stepwise movement, which in turn drives the gear train 11.

As has been described, the quartz clock movement consists of two major assemblies. These are the quartz crystal controlled electronic clock circuit 1 on the printed circuit board 7 which also includes the battery charger 12, 13, and the electromechanical assembly 2 with the stepping motor 9 as an integral part of the gear train 11 to provide the respective rotary motion of the seconds, minutes and hours shafts. The third assembly constitutes the gearwheels of the switch device.

ELECTRONIC CIRCUIT

For more detailed information particulars, a quartz crystal stabilized oscillator 4 operating at 4.194 MHz forms the time-keeping element of the circuit. In this case a quartz 5 of the AT cut type was chosen for good temperature characteristics, at the same time providing high mechanical stability.

With the main effects of ageing anticipated in an ageing process of the quartz component prior to calibration a highly consistent accuracy is attained over the service life of the movement.

Subsequently the oscillator frequency is transformed into rectangular pulses supplied to a 23-stage binary frequency divider to deliver the output frequency of 0.5 Hz. Upon voltage duplication and shaping of the signal this is supplied to the excitation coil 33 of the stepping motor 9.

The major part of the clock circuit with the oscillator, divider and output stages is integrated on one CMOS chip. With a minimum of discrete electronic components this provides an economic solution of high reliability.

Under this aspect the charger circuit 12, 13 provided to intermittently recharge the NiCd cell power supply, is also incorporated on the same printed circuit board 7. Thus separate assembly and electrical connections can be eliminated. The protecting circuit completes the electronic part, safeguarding the circuit against damage from voltage peaks in the event of battery failure or by electrostatic interference.

As the clock circuit is capable of operating on 1.25 V DC nominal voltage, a single NiCd cell 14 provides sufficient power supply.

ELECTRO-MECHANICAL MOVEMENT

The stepping motor 9 is fully integrated into the movement, the stepping motor comprising a rotor 26 in the form of a disc-shaped permanent magnet 26, the face side of which is oriented towards the stator poles 30. Accordingly, the magnetic flux of the 6-pole magnet 26 is orientated in the axial direction.

The specific asymmetrical configuration of the stator poles 30 ensures that the rotor magnet 26 adopts a preferred position while immobile between steps. This feature lends the stepping motor unidirectional self-starting properties.

Injected into the rotor 26 is a plastic moulded spindle 21, 22, 24 with a pinion 25 to drive the gear train. Parallel to the rotor disc 26, the spindle carries the freely rotatable iron washer 27 serving as a collector of the magnetic flux. Due to its magnetic coupling with the rotor 26, the washer 27 provides an inertia damping of the motor steps. Since this damping effect is achieved without the use of lubricants or damping fluids and is not subject to wear it will not deteriorate in service. Together with the materials chosen for the gears, mainly plastic mouldings, this design feature ensures a low noise level of the movement in operation. The magnet flux return disc 27 may be mounted floating or suspended on the rotor shaft 21 (i.e., partially mounted fixed to and partially free on the shaft 21 and the upper end of the rotor body 24, such that the disc 27 can rotate jointly with, or relative to, the rotor 22 and the shaft 21 depending on the action thereof). By such a type of formation of the single phase stepping motor, the return disc 27 additionally is used as an inertia damping mass, which mass is magnetically coupled with the magnetic rotor disc 26. This coupling acts such that after the end of a step, the return disc 27 continues to turn, while the rotor 22 begins to slacken or rotate back. By means of the attraction of both parts thereby there arises a braking or slowing down of the rotational movement of both parts and consequently the desired damping. Particularly favorable damping values may be attained when a narrow air gap exists between the magnetic disc 26 and the return disc 27, since then a soft coupling arises between the parts.

The friction coupling on the minute gear provides the possibility to set the clock by turning the minute hand cannon.

The invention offers the following advantages in addition to those mentined previously:

Unidirectional self-starting single-phase stepping motor 9 does not require a starting aid;

Non-ageing damping requires no servicing;

Simplified setting mechanism, i.e., by knob-shaped minute hand boss 54 eliminates gear components and provides the possibility for flush mounting of a thermostat;

The battery charger circuit is incorporated in the printed circuit of the clock electronics;

Operation occurs with only one NiCd cell battery;

Battery mounting clamps 17 are incorporated in the plastic housing of the movement;

The front plate and the upper movement plate are combined in one moulding.

While there has been disclosed one embodiment of the invention it is to be understood that this embodiment is given by example only and not in a limiting sense.

We claim:

1. In an electrical clock with a quartz oscillator, a frequency divider connected to and following the oscillator and an output stage driven by the frequency divider, in the output of the output stage there being disposed a single phase stepping motor acting on a clockwork gear train driving an hour tube and a coaxially mounted minute tube, and a storage battery supplying the operating voltage and a charging circuit for the battery, the improvement wherein the single phase stepping motor, including an excitation coil, the clockwork gear train and a carrier element form a self-contained construction assembly, as a connectable first component, a single printed circuit board, the quartz oscillator, the frequency divider, the output stage and the charging circuit being disposed on said single printed circuit board and constitute an electrical assembly, as a connectable second component, two conducting pins being fastened to said excitation coil and operatively connecting said first component with said second component electrically, a carrier plate being formed with an opening, said first component and said second component being secured mechanically on said carrier plate, said hour tube and said minute tube, respectively, extending through said opening, gearwheels of a switch device as a third component, bearing means for mounting said gearwheels of the switch device, said bearing means are disposed on a front side of said carrier element, said front side faces away from the clockwork gear train, said carrier element includes means for mounting said clockwork gear train, said gearwheels are operatively connected to said hour tube, said bearing means includes pins formed on said front side of said carrier element, said pins are arranged on a circle concentric to the hour tube, said gearwheels of the switch device include, a gear concentrically secured to the hour tube, an adjustment disc of the switch device having an inner toothing concentric to the hour tube, a plurality of pinions rotatably disposed on said pins and intermeshing simultaneously with said gear and said inner toothing.

2. The electrical clock as set forth in claim 1, wherein said construction assembly includes said carrier element and another carrier element disposed parallel to one another, said clockwork gear train includes gears having shafts, said stepping motor includes a rotor shaft and a rotor mounted thereon and two flat stator sheets having stator poles, said shafts of said gears and of said rotor and said hour tube and said minute tube, respectively, are mounted in said carrier elements, said flat stator sheets are fastened to said another carrier element, said another carrier element includes a projection means formed thereon for mounting one end of said rotor shaft, a bearing secured on said another carrier element, the other end of said rotor shaft is mounted in said bearing, an axially magnetized magnetic disc is disposed parallel to said stator sheets and is operatively secured to said rotor shaft, an iron disc is freely rotatably mounted on said rotor shaft on a side magnetic disc which side faces away from said stator sheets, said stator sheets include parts remote from said stator poles, a bridge part is secured to said parts of said stator sheet and connects said stator sheets, said excitation coil is disposed on said bridge part and is located outside of said another carrier element.

3. The electrical clock as set forth in claim 1, wherein said third component constitutes a self-contained separately produceable additional construction assembly, selectively assemblable as a unit on said bearing means without engagement in the clockwork gear train.

4. The electrical clock as set forth in claim 3, wherein said construction assembly as the first component and said electrical assembly as the second component are separately produceable each as a self-contained operative unit, and are assemblable mechanically together on the carrier plate and electrically connectable via said conducting pins.

5. The electrical clock as set forth in claim 1, further comprising a holder of the minute tube is formed as an adjustment knob.

6. The electrical clock as set forth in claim 5, wherein the clockwork gear train includes a seconds shaft, said adjustment knob forms a recess, a disc formed with markings is seated on said seconds shaft, said disc is rotatably disposed in said recess.

* * * * *